US005959372A

United States Patent [19]

Every

[11] Patent Number: 5,959,372

[45] Date of Patent: Sep. 28, 1999

[54] POWER MANAGEMENT CIRCUIT

[75] Inventor: Robert C. Every, Perkiomenville, Pa.

[73] Assignee: Emerson Electric Co., St. Louis, Mo.

[21] Appl. No.: 08/991,115

[22] Filed: Dec. 16, 1997

Related U.S. Application Data

[60] Provisional application No. 60/053,303, Jul. 21, 1997.

[51] Int. Cl.[6] ..... H01H 83/20

[52] U.S. Cl. ..... 307/131; 361/152; 361/154; 379/350; 379/377

[58] Field of Search ..... 307/113, 131; 361/154, 152; 73/700; 219/130.32; 379/377, 350; 363/97

[56] References Cited

U.S. PATENT DOCUMENTS

| | | | |
|---|---|---|---|
| 3,689,734 | 9/1972 | Burley et al. | 219/130.32 |
| 4,238,721 | 12/1980 | DeLuca et al. | 320/122 |
| 4,317,963 | 3/1982 | Chea | 379/377 |
| 4,345,296 | 8/1982 | Breitling | 361/154 |
| 4,725,937 | 2/1988 | Kenny et al. | 363/97 |
| 4,823,070 | 4/1989 | Nelson | 323/285 |
| 5,058,582 | 10/1991 | Thaler et al. | 128/419 |
| 5,495,769 | 3/1996 | Broden et al. | 73/718 |

*Primary Examiner*—Albert W. Paladini
*Attorney, Agent, or Firm*—Arnold White & Durkee

[57] ABSTRACT

An improved power management circuit for regulating current on a loop converts a high voltage, low current loop circuit to a low voltage source for devices associated with the loop. Additionally, the improved power manager provides a port for frequency shift key (FSK) transmit and receive signals.

19 Claims, 10 Drawing Sheets

POWER MANAGEMENT CIRCUIT

CROSS-REFERENCE TO RELATED APPLICATION

This application claims the benefit of U.S. Provisional Application No. 60/053,303 entitled "Improved Power Management Circuit," filed Jul. 21, 1997 by the same inventor, which is incorporated herein by reference in its entirety.

BACKGROUND OF THE INVENTION

In general, two wire, low current loop circuits are used with a variety of devices, for example, flow measurement devices. These loop circuits typically include a loop current regulating circuit which varies the current in the loop, generally from 4 to 20 mA, according to a signal received from the associated device. For example, when the loop circuit is used with a flow measurement device, such as a flow meter in a typical process control loop, the flow meter provides a signal ranging from 4 to 20 mA which represents the measured flow rate. This signal is then provided to a controller, which compares the signal received from the measurement device to a signal which represents a desired flow rate, or "set point." The controller calculates a corrective signal (which also may be a 4 to 20 mA signal) that is output to a control device such as a control valve. The control device exerts an influence on the process in response to the received corrective signal to bring the process to the desired flow rate.

The device connected to the loop circuit may include various electronic components such as a microprocessor or display device. It is desirable to power these electronic components via the loop circuit, rather than powering the electronic components via a separate power circuit, thereby reducing installation and maintenance costs. However, these electronic components generally require high current, low voltage as opposed to the low current, high voltage typically supplied by the loop circuit. Moreover, the electronic components of the associated device often communicate digitally over the loop circuit via Frequency Shift Key ("FSK") signals. Using the 4 to 20 mA circuit for communication further reduces wiring requirements, in turn providing additional cost reductions. Several FSK protocols exist, including the HART protocol or other protocols which modulate the loop current at audio frequencies. Accordingly, efficient low powered power management components are needed to regulate the distribution of energy to the electronic components without introducing noise onto the loop circuit that can interfere with the digital communication or presenting a complex impedence to the transmitting source which may attenuate or distort the signal.

FIG. 1 illustrates a typical prior art loop current regulating circuit 100. The prior art loop current regulating circuit 100 is connected between positive loop voltage +LOOP and negative loop voltage −LOOP. The loop current regulating circuit 100 includes a current control circuit 112 and a current compare circuit 113. The current compare circuit 113 senses an actual current on the loop and compares it to a current demand signal 114 received from an associated device (not shown). The demand signal 114 provided by the associated device is in response to a sensed process variable. For example, for an associated device which measures the flow rate of a fluid such as a flow meter, the demand signal provided to the current compare circuit 113 represents the sensed flow rate. The current compare circuit 113 then signals the current control circuit 112 to increase or decrease the loop current to meet the current demanded by the current demand signal 114. The current control circuit 112 utilizes a linear shunt regulator to vary the current in the loop in accordance with the signal received from the current compare circuit 113 and to form a pre-regulator circuit for controlling start-up functions at initial application of power.

The linear shunt regulator includes a transistor 115, a zener diode 116, and a resistor 117. The transistor 115 operates linearly and becomes more or less conductive based on the signal from the current compare circuit 113. If the loop current needs to be increased, the transistor 115 becomes more conductive. As the transistor 15 becomes more conductive, the voltage at node 118 increases. When the voltage at node 118 reaches approximately 7 volts, the zener diode 116 will turn on. At this point, all current in excess of the demanded loop current will sink to ground through the zener diode 116.

However, the prior art loop current regulating circuit 100 provides inexact current control at best. In the prior art circuit only one active device is utilized and the path to ground is not controlled by the active device. Rather, the path to ground is through the zener diode 116 and therefore, is only indirectly controlled. Thus, precise current control is not possible. Moreover, the current control of the loop current regulating circuit 100 is not smooth, because of the abrupt nature of the linear shunt regulator: the zener diode 116 is either on or off. Another problem created by the prior art circuit is that the current control circuit creates a complex impedance. This complex impedance can distort FSK signals, if the circuit is used with a device that transmits and receives FSK signals over the loop circuit. If the digital communications signals cannot be reliably transmitted and received over the loop circuit, the cost advantage gained through reduced wiring is lost.

Further, it is desirable to power peripheral electronics of an associated device from the loop circuit 100 at node 118. However, the prior art loop current regulating circuit 100 causes several problems when used to provide power to an associated device. First, the power drain is great due to the loss associated with the zener diode 116. Thus, the prior art loop current regulating circuit 100 is very inefficient. Additionally, the maximum power provided to any associated device is limited, because the voltage at node 118 is limited to a maximum of approximately 7 V by the zener diode 116. Therefore, the loop current regulating circuit 10 provides poor power amplification. Moreover, if FSK signals are transmitted and received using the prior art circuit, noise can be introduced onto the loop by the FSK circuits connected to the loop current regulating circuit 100, which regulates power to the associated device.

Finally, devices employed on low current loop circuits are often used in hazardous areas where electrical energy or sparks could cause disastrous ignition of surrounding explosive gasses or particles. Accordingly, the power management components must be designed to meet the standards set forth for an Intrinsically Safe device. Such devices receive their operating voltage through energy limiting barriers, and must be specially constructed to reduce or eliminate electrical discharges capable of causing combustion of the surrounding materials.

Thus, a need exists for an improved power management circuit that overcomes the referenced and other limitations of prior art power management circuits.

SUMMARY OF THE INVENTION

The present invention overcomes the described and other limitations of traditional power management circuits by providing an improved power management circuit. In one aspect of the invention, a loop current regulating circuit produces a demanded current in a loop current circuit that contains an actual current and provides power to an associated device. The power management circuit includes a current compare circuit which receives a demanded current signal and compares the actual current to the demanded current signal and produces a control signal. An active upper device receives the control signal and conducts based on the control signal to produce the demanded current. An active lower device receives the control signal and conducts based on the control signal to produce the demanded current. A voltage is produced at an intermediate node where the active upper device and the lower device are electrically coupled, and the voltage at the intermediate node is able to float to the voltage necessary to provide the demanded current.

In another aspect of the current invention, the loop current regulating circuit includes a receive FSK circuit and a transmit FSK circuit coupled to the loop current circuit. In yet another aspect of the invention, a power regulating circuit is further included which receives the voltage from the intermediate node and outputs at least one lesser voltage to an associated device.

In another embodiment of the invention, a method of creating a demanded current in a loop current circuit containing an actual current comprising the steps of sensing the actual current on the loop current circuit, comparing the actual current to a signal representation of the demanded current, and creating a control signal from a comparison of the actual current and the signal representation of the demanded current. Further, the method of the invention includes creating a demanded current by controlling an upper active device and a lower device with the control signal such that voltage at an intermediate node between the upper active device and the lower device can vary as necessary to attain the demanded current. In another aspect, the method also includes stepping down the voltage at the intermediate node and supplying the voltage to an associated device.

DETAILED DESCRIPTION OF THE INVENTION

Figure 2:
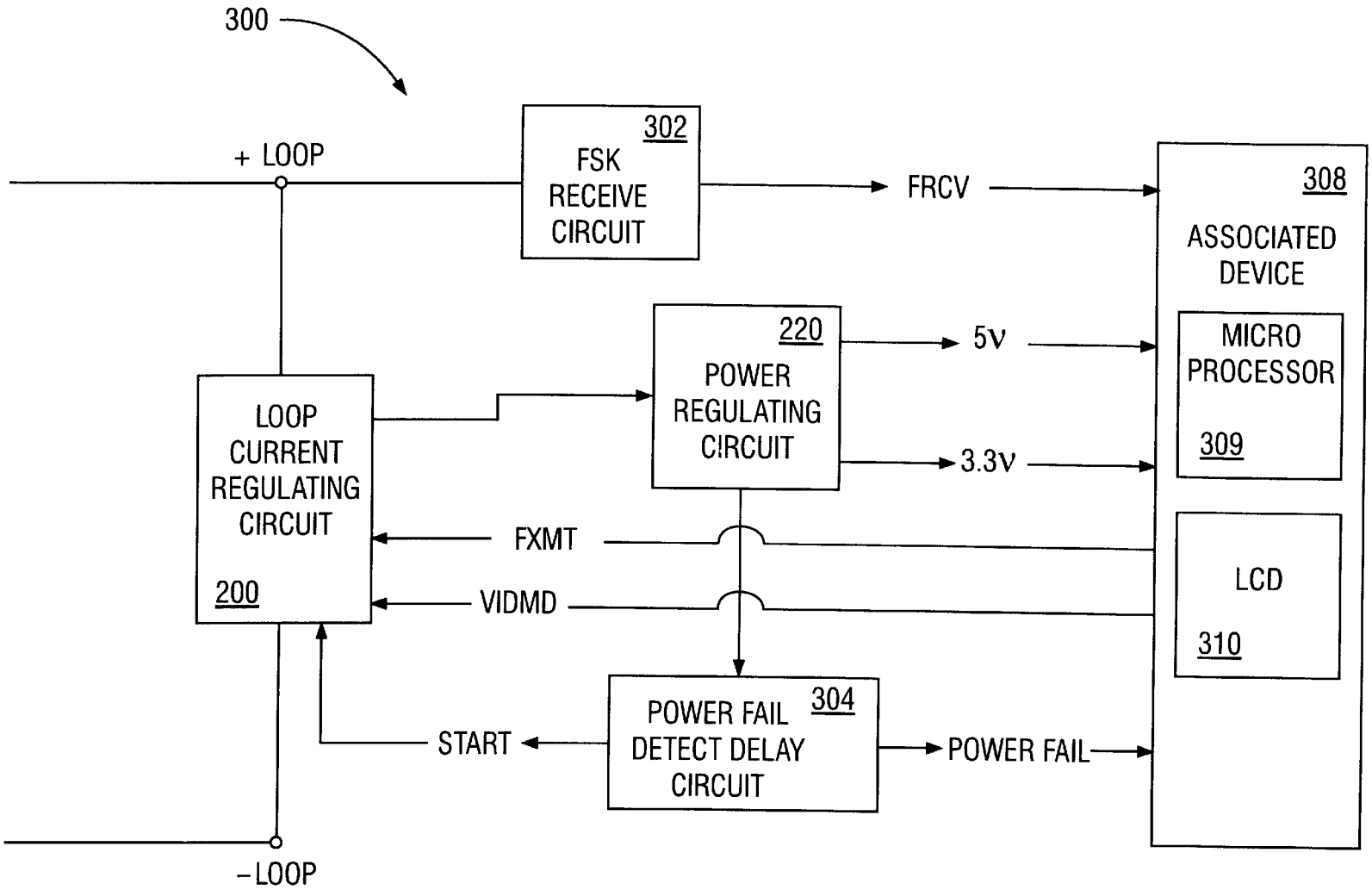
FIG. 2 illustrates an overview of the power management circuit of the present invention.

Turning to the drawings and in particular, to FIG. 2, an exemplary power management circuit 300 in accordance with the present invention is illustrated. In general, the power management circuit 300 includes an improved loop current regulating circuit 200 connected between positive loop voltage +LOOP and negative loop voltage −LOOP, an FSK receive circuit 302 coupled between +LOOP and an associated device 308, a power regulating circuit 220 connected between the loop current regulating circuit 200 and associated device 308, and a power fail detect delay circuit 304 connected between power regulating circuit 220 and loop current regulating circuit 200. Associated device 308 may include peripheral electronic devices; an exemplary embodiment includes a microprocessor 309 and a liquid crystal display (LCD) 310. Examples of other peripheral electronics include memory devices such as flash read only memory (ROM) and static random access memory (RAM).

In an embodiment of the invention, the associated device 308 is an instrument for measuring a process variable, such as a flow meter. In alternate embodiments, the associated device 308 may comprise a pressure or level transducer, for example. Associated device 308 generates a current demand signal VIDMD corresponding to a measurement of the process variable which is input to the loop current regulating circuit 200. The improved loop current regulating circuit 200 functions to control the loop current in response to current demand signal VIDMD such that the loop current represents the measurement of the process variable. For example, in a typical process control loop, the loop current ranges from 4 to 20 mA. Thus, for an associated device 308 such as a flow meter, a loop current of 4 mA may represent a minimal measured flow rate, while a loop current of 20 mA may represent a maximum flow rate.

As discussed in the Background of the Invention section herein above, it is desirable to power the associated device's 308 peripheral devices via the loop circuit. Hence, the power regulating circuit 220 of power management circuit 300 further functions to convert the high voltage, low current loop power to the low voltage, high current power source required by the peripheral electronics. In the exemplary embodiment of FIG. 2, the power management circuit 300 converts the 4 to 20 mA loop at 24 volts (nominal) to a 3.3 volt power source for the microprocessor 309. In addition, the power regulating circuit 220 provides +5 volts for the LCD display 310.

Further, modulating communications to and from associated device 308 on the 4 to 20 mA loop rather than providing a separate pair of wires solely for communications reduces the amount of wiring necessary, in turn reducing installation and maintenance costs for a typical implementation of a process control loop. Thus, the associated device 308 transmits and receives digital communications via FSK signals over the 4 to 20 mA loop. The FSK receive circuit 302 extracts the digital communications signal FRCV from the +LOOP and provides it to the associated device 308. Transmitted digital communications FXMT are provided from the associated device 308 to the loop current regulating circuit 200, which modulates the FXMT signal onto the 4 to 20 mA loop.

The exemplary power management circuit 300 also includes a power fail detect delay circuit 304, which is used to increase the power supplied by the loop current regulating circuit 200 to the power regulating circuit 220 when the power regulating circuit 220 indicates that its load is drawing more power than it is receiving. Further, the power fail detect delay circuit 304 will alert the microprocessor of the associated device 308 that the power regulating circuit 220 is not receiving enough power.

Figure 3:
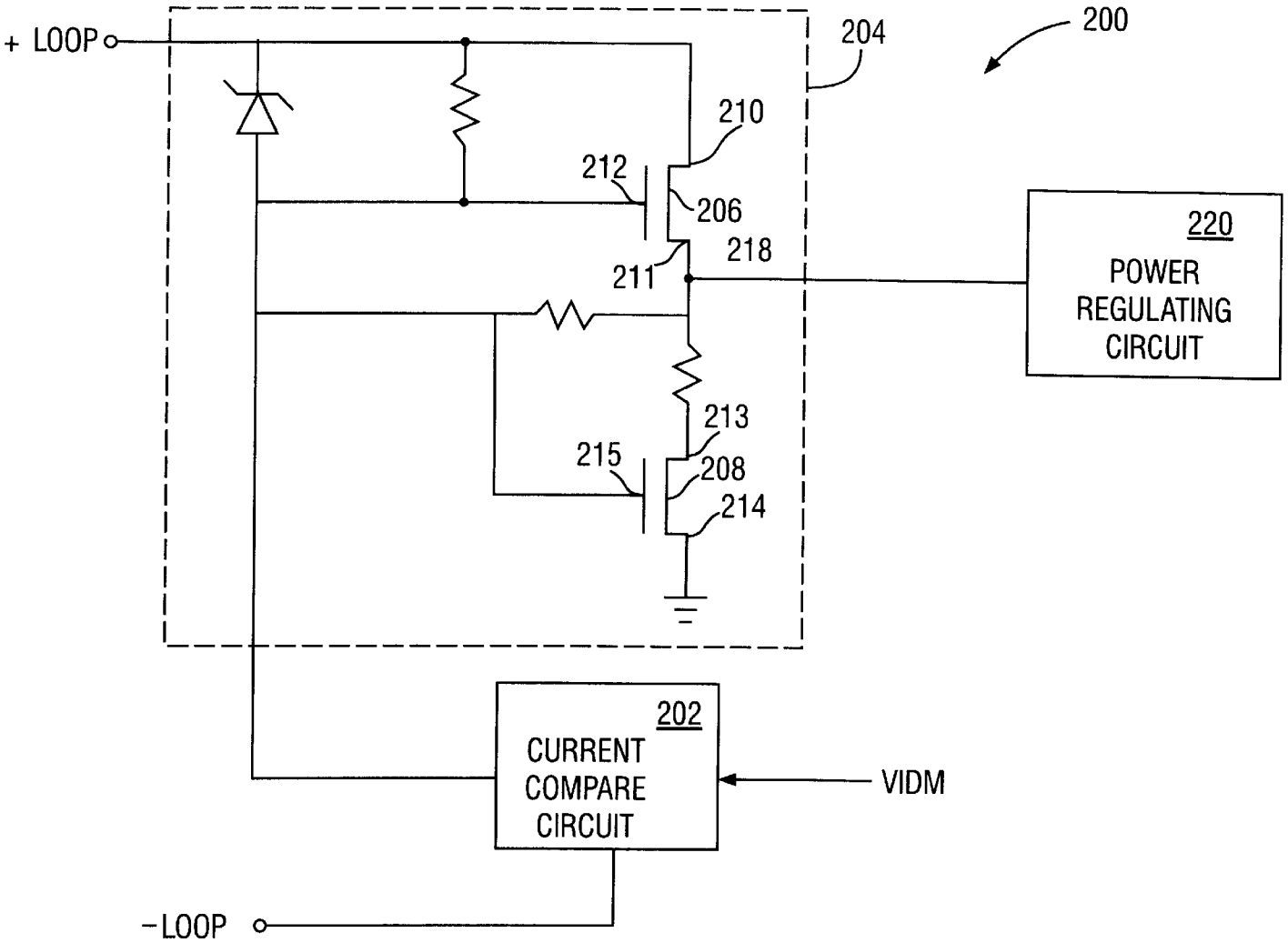
FIG. 3 illustrates a simplified embodiment of the loop current regulating circuit of the present invention, highlighting the current control circuit.
Figure 4:
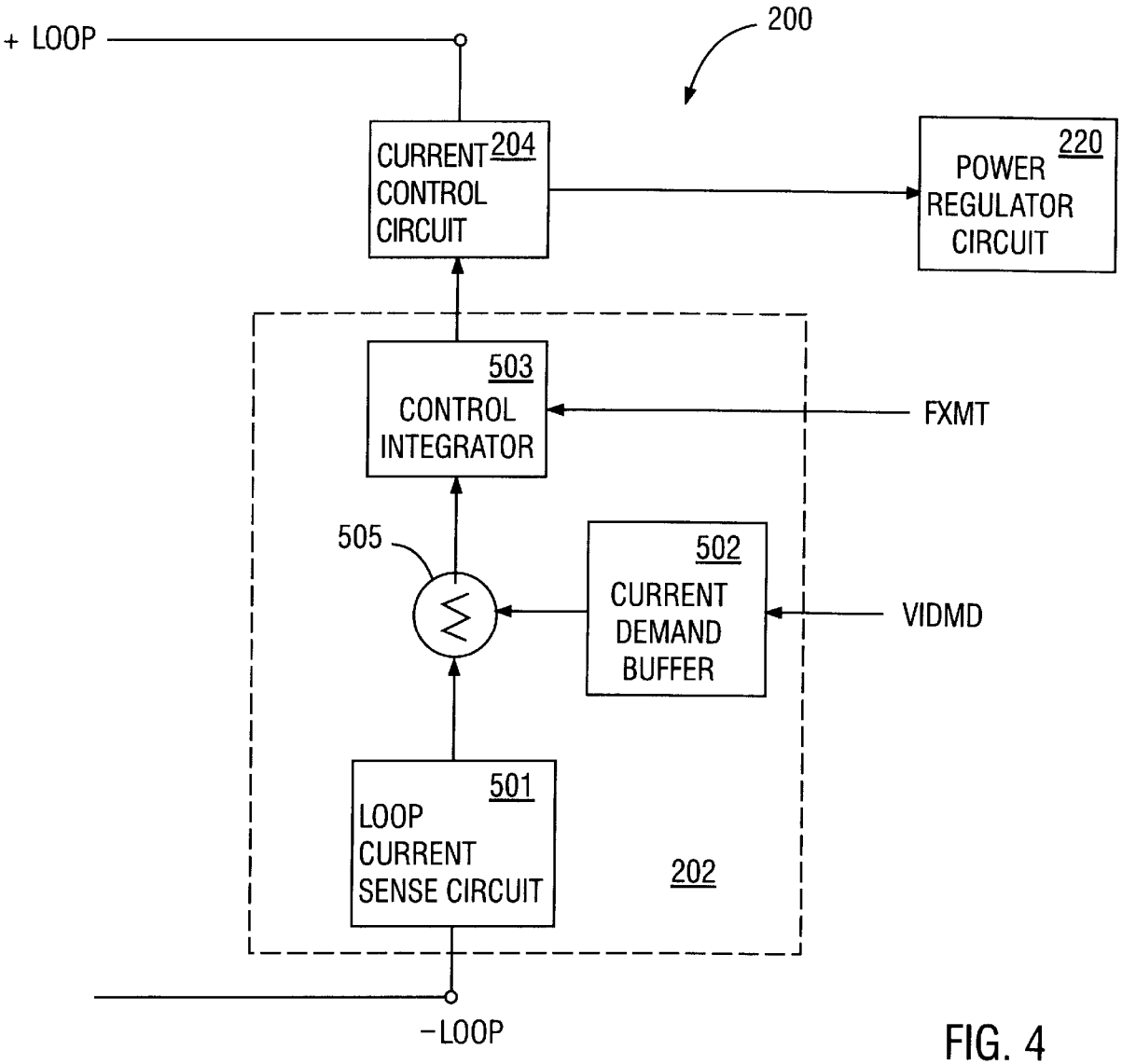
FIG. 4 illustrates a simplified embodiment of the loop current regulating circuit of the present invention, highlighting the current compare circuit.

Referring now to FIG. 3 and FIG. 4, the improved loop current regulating circuit 200 in accordance with the present invention is illustrated. The loop current regulating circuit 200 is connected between positive loop voltage +LOOP and negative loop voltage −LOOP, and includes a current compare circuit 202 and a current control circuit 204. The main components of the current control circuit 204 are shown in FIG. 3, and FIG. 4 illustrates the functional areas of the current compare circuit 202. The current compare circuit 202 senses the actual current on the loop and compares it to a current demand signal VIDMD which is received from associated device 308. Based on the comparison between the actual loop current and the current demand signal VIDMD, a control signal is generated and sent to the current control circuit 204. The current control circuit 204 regulates the current in the loop circuit based on the control signal received from the current compare circuit 202.

An upper active device 206 and a lower active device 208 are at the heart of the current control circuit 204, illustrated in FIG. 3. The upper active device 206 has an input node 210, an output node 211, and a control node 212, and the lower active device 208 also has an input node 213, an output node 214, and a control node 215. Both the upper active device 206 and the lower active device 208 operate linearly. In one embodiment of the present invention the upper and lower active devices 206 and 208 are metal oxide semiconductor (MOS) field effect transistors (FET).

The upper active device 206 is controlled via the control signal from the current compare circuit 202 at the control node 212. The lower active device 208 is controlled via the control signal from the current compare circuit 202 at the control node 215. Because both active devices 206 and 208 operate linearly, the active devices 206 and 208 will conduct more or less depending on the control signal from the current compare circuit. The upper and lower active devices 206 and 208 are biased such that when the upper active device 206 and the associated device 308 (and peripherals) cannot satisfy the current demand, the lower active device 208 conducts. When the lower active device 208 conducts, current is sunk to ground at output node 214.

Figure 1:
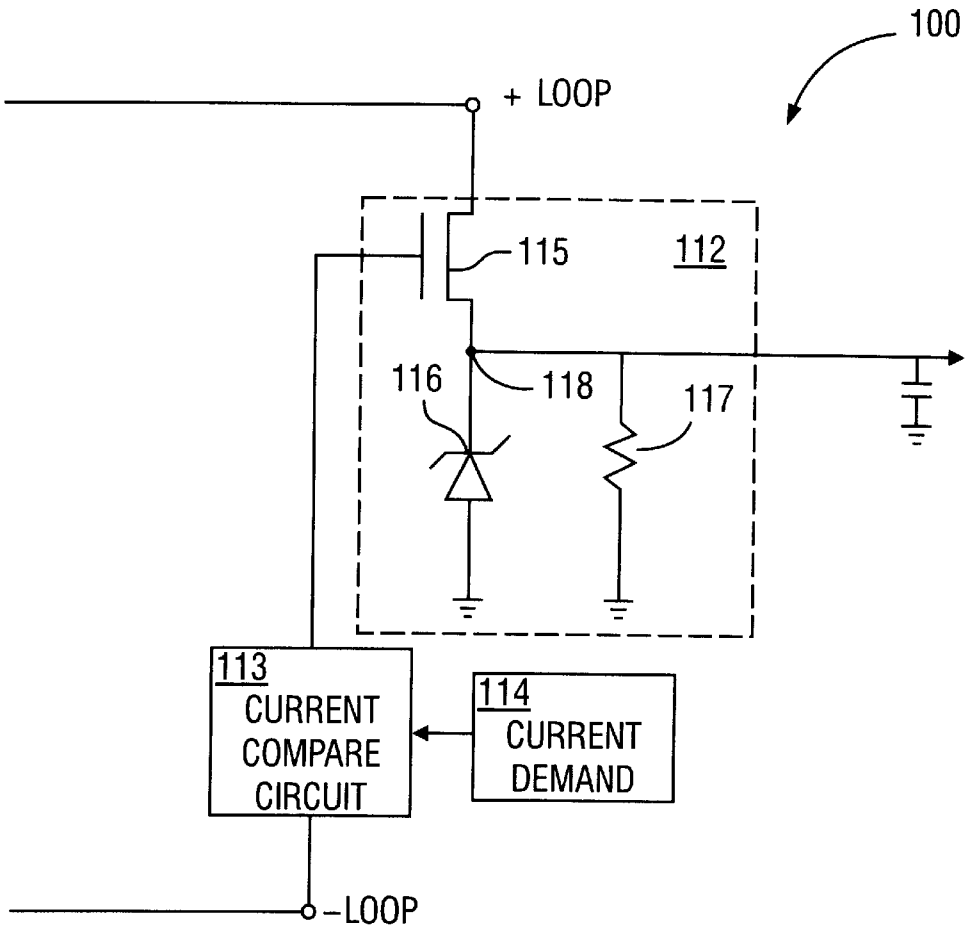
FIG. 1 (PRIOR ART)
FIG. 1 illustrates a simplified prior art loop current control circuit.

Power is provided to power regulating circuit 220 at intermediate node 218. Intermediate node 218 is formed between the output node of the upper active device 206 and the input node 213 of the lower active device. Because the lower active device 208 is utilized to sink current to ground, the voltage at intermediate node 218 is allowed to float. Therefore, the voltage at intermediate node 218 is allowed to reach whatever voltage is necessary to provide the demanded current and is not held at an artificial voltage as with the prior art. This configuration affords for a smooth control of current. Moreover, only as much current as is necessary is sunk to ground using the lower active device 208, thereby providing an efficient circuit. Additionally, the control of the current utilizing the current control circuit 204 is much more precise than the prior art circuit shown in FIG. 1.

FIG. 4 illustrates the major components of the current compare circuit 202 of loop current regulating circuit 200. As explained above, the loop current regulating circuit 200 is made up of the current control circuit 204 and the current compare circuit 202. The current compare circuit 202 includes a loop current sense circuit 501, a current demand buffer 502, a summing junction 505, and a control integrator 503.

The current received from the low current source −LOOP is sensed by the loop current sense circuit 501. The current demand signal VIDMD from associated device 308 is buffered in the current demand buffer 502. The current demand signal VIDMD represents the desired loop current. The sensed current from the loop current sense circuit 501 is compared to the current demand signal VIDMD at summing junction 505, which generates an error signal that is output to the control integrator 503. The control integrator 503 receives the signal from the summing junction 505 and the transmit FSK signal FXMT from the associated device 308. The transmit FSK signal FXMT and the signal from summing junction 505 are integrated by control integrator 503. The output of control integrator 503 is input to the current control circuit 204, which adjusts the loop current accordingly. Further, the current control circuit 204 supplies power to the power regulating circuit 220 and as necessary dissipates excess power to ground.

Figure 5:
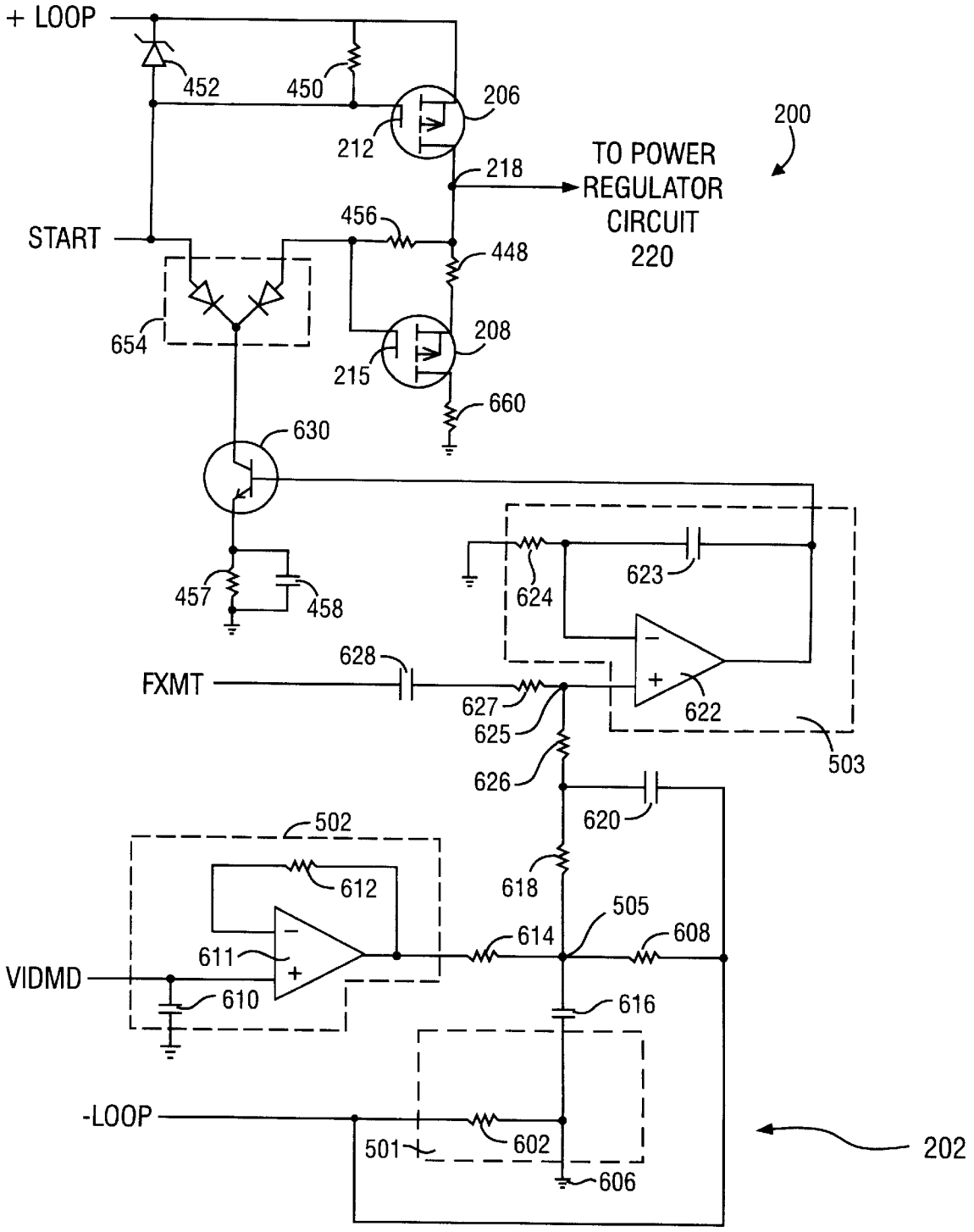
FIG. 5 is a schematic diagram of an exemplary embodiment of the loop current regulating circuit.

An example circuit layout for loop current regulating circuit 200 is shown in FIG. 5. The loop current sense circuit 501 includes a sense resistor 602, which may comprise two resistors in parallel. All current is forced through the sense resistor 602 because one side of the loop sense resistor 602 is connected to −LOOP voltage and the other side is connected to local ground 606, which creates a voltage that is supplied to summing junction 505 through resistor 608. The other input to the summing junction 505 is the output of the current demand buffer 502 through a resistor 614. The current demand buffer 502 includes a capacitor 610, an operational amplifier 611 and a resistor 612. The result is the voltage across the sense resistor 602 being the same as the current demand voltage, but of negative polarity. In the exemplary embodiment illustrated in FIG. 5, the VIDMD signal originates in a digital to analog converter circuit (not shown) on the associated device 308 microprocessor 309 circuit board. It is scaled and biased to create a loop current ranging from 3.85 mA to 24.7 mA.

A filter comprising a capacitor 616, a resistor 618 and a capacitor 620 is coupled to the summing junction 505, and operates to filter the VIDMD signal as output from summing junction 505 and to maintain smooth control, transient voltage rejection and proper impedance to the FSK signals. The control integrator 503 includes an operational amplifier 622, a capacitor 623 and a resistor 624. At the junction 625 formed by resistor 626 and resistor 627/capacitor 628, the FSK transmit signal FXMT is injected onto the filtered signal received from the summing junction 505 and both are input into the operational amplifier 622 of the control integrator 503.

The output of the control integrator 503 is connected to the base of a reach up active device 630. In the embodiment illustrated in FIG. 5, the reach up active device 630 is an NPN transistor. As the control signal output from the control integrator 503 increases, transistor 630 increasingly conducts, causing its collector voltage to go low. The collector of transistor 630 is coupled to control nodes 212 and 215 of upper and lower active devices 206 and 208, respectively. In the embodiment of FIG. 5, upper and lower active devices 206 and 208 comprise P-channel enhancement metal oxide semiconductor field effect transistors (E-MOSFET), with control nodes 212 and 215 comprising the gates of MOSFETs 206 and 208, respectively. The low at the collector of transistor 630 pulls down the gate 212 of upper active device 206 and the gate 215 lower active device 208. The reach up active device 630, upper active device 206, and lower active device 208 operate linearly. Thus, as the collector of the reach up active device 430 goes lower, the control nodes 212 and 215 of the upper active device 206 and lower active device 208 are pulled down. In turn, when the control signal output from the control integrator 503 decreases, the reach up active device 630 conducts less, causing the upper active device 206 and the lower active device 208 to conduct less.

The control node 212 of the upper active device 206 is pulled up by a resistor 450 and is protected from excessive voltage by a zener diode 452. The gate of the lower active device 208 is pulled up by a resistor 456 and is automatically protected against excessive voltage drop by the combination of zener diode 452 and an emitter resistor 457 of the transistor 630. A capacitor 458 is connected in parallel with the emitter resistor 457 in order to create a zero in the response of the loop circuit. A source resistor 448 of the lower active device 208 adds some negative feedback to the lower active device 208.

To summarize the operation of the loop current regulating circuit 200 as embodied in FIG. 5, if the current through the loop current sense circuit 501 decreases, the voltage across it becomes less negative (with respect to ground), which causes the summing junction 505 to go positive, as does the control integrator 503 output. This increases conduction through reach up transistor 630 causing its collector voltage to decrease. The upper active device 206 admits more loop voltage and, if necessary, the lower active device 208 sinks more current. Current increases through sense resistors 602 and 604, causing the input to summing junction 505 to go negative which restores the balance at summing junction 505.

Figure 6:
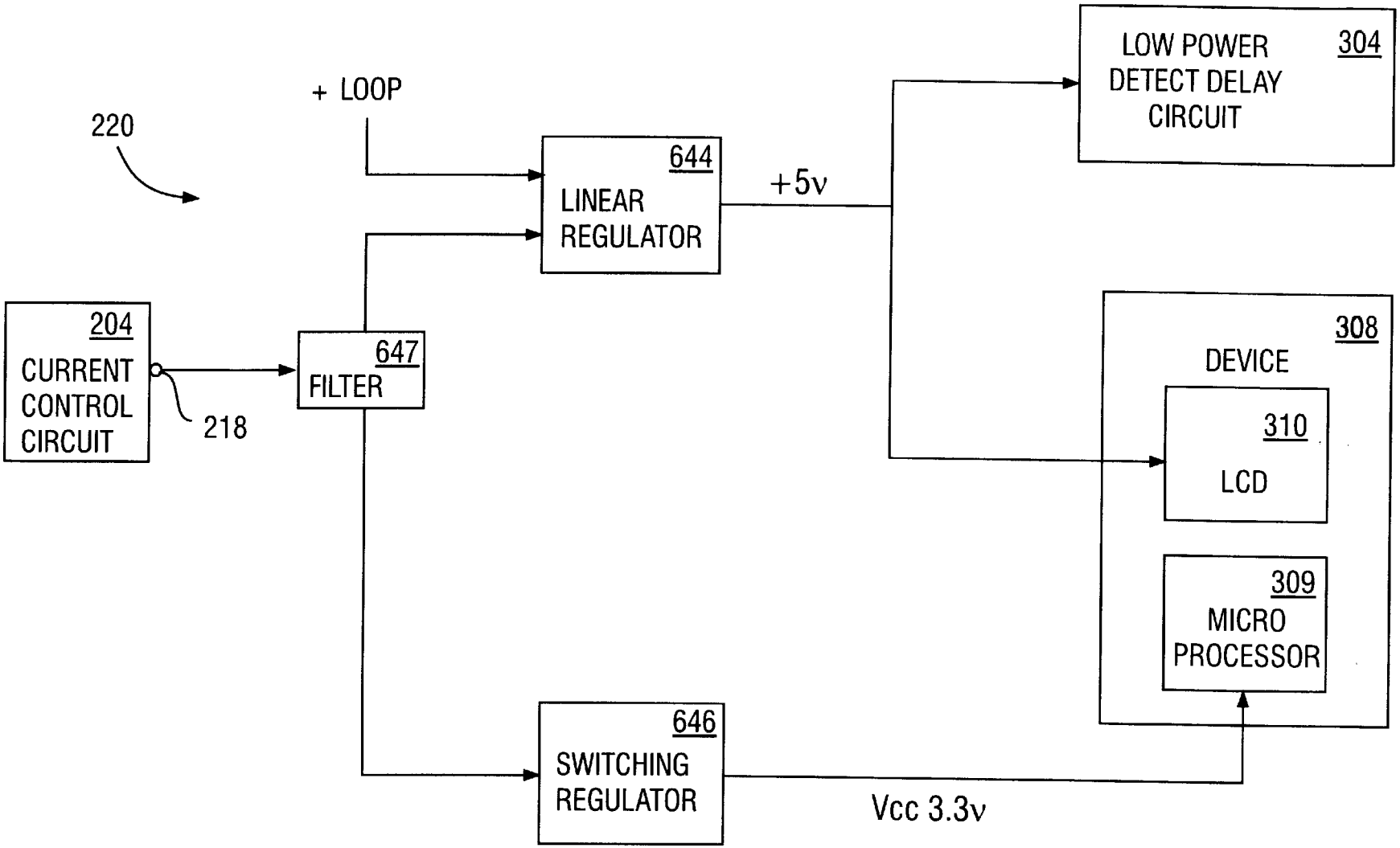
FIG. 6 illustrates a simplified embodiment of the power regulating circuit of the present invention.

Referring now to FIG. 6, the primary components of power regulating circuit 220 are illustrated in a simplified block diagram. Power regulating circuit 220 includes a linear regulator 644 and a switching regulator 646. Loop voltage is presented to linear regulator 644 and switching regulator 646 from the current control circuit 204 through a filter 647. Additionally, positive loop voltage +LOOP is supplied to linear regulator 644. In an embodiment of the invention, power regulating circuit 220 provides the required low voltage, high current supply for the microprocessor 309 and LCD 310 of associated device 308, and additionally powers the low power detect delay circuit 304. In the exemplary embodiment illustrated in FIG. 6, the power regulating circuit 220 provides, inter alia, a high current supply voltage Vcc of 3.3 volts for microprocessor 310. This conversion from the low current, high voltage 4 to 20 mA loop occurs in the switching regulator 646, and a mathematical example of the conversion is as follows:

Loop voltage=23 volts, and Loop current=4 mA (worst case). Thus, power available=0.092 watts:

Power=voltage*current=23 volts*4 mA=0.092 watts

A switching regulator such as switching regulator 646 of the embodiment illustrated in FIG. 6 typically is about 75% efficient, therefore, realized output power is about 0.069 watts (0.092*0.75). For a Vcc of 3.3 volts, the available current is 20.9 mA:

Current=Power/voltage=0.069/2.3=20.9 mA

Figure 7:
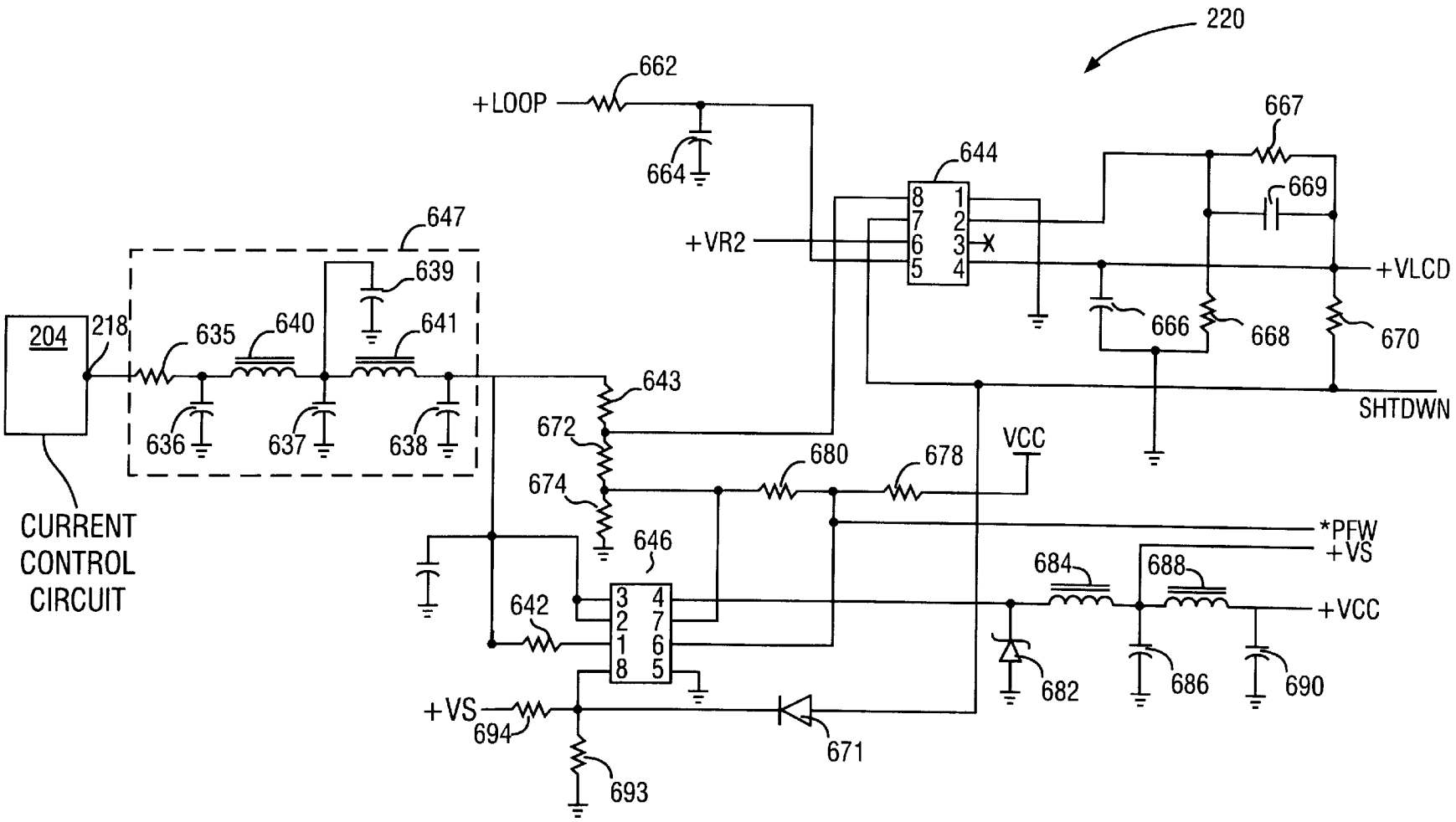
FIG. 7 illustrates a circuit diagram of an exemplary embodiment of the power regulating circuit.

An exemplary circuit layout of power regulator circuit 220 is illustrated in FIG. 7. In the exemplary embodiment of FIG. 7, an LT1120A Micropower Regulator from Linear Technology is used as the linear regulator 644. The pin functions for the exemplary linear regulator 644 are as follows:

| Pin | Function |
|---|---|
| 1 | ground |
| 2 | feedback |
| 3 | shutdown (not used) |

-continued

| Pin | Function |
|---|---|
| 4 | main output |
| 5 | input supply |
| 6 | 2.5 v reference |
| 7 | comparator output |
| 8 | comparator input |

The linear regulator 644 receives the +LOOP voltage through a filter formed by resistor 662 and capacitor 664 as its input supply. The linear regulator 644 provides an output +VLCD of 5 volts, which powers LCD 310 of associated device 308 and the low power detect delay circuit 304. The output of the linear regulator 644 is filtered by a capacitor 666. The linear regulator 644 output +VLCD is fed back through resistors 667 and 668 and a capacitor 669.

The linear regulator 644 includes a 2.5 volt reference source, and an open collector voltage comparator. The voltage comparator which may be used to detect when input voltage is below a predetermined level. The voltage created in loop current regulating circuit 200 at intermediate node 218 is passed through a filter 647 comprising a resistor 635, capacitors 636, 637, 638 and 639, and inductors 640 and 641 and provided to the linear regulator 644 comparator input through a resistor 643. If the input voltage falls below the predetermined level, the linear regulator 644 comparator output provides a shut down signal SHTDWN which may be fed back to the switching regulator 646 through a diode 671 to shut it down. If the shut down signal SHTDWN signal is used, it is also fed back to the linear regulator 644 through resistor 670.

The voltage from intermediate node 218 is passed through filter 647 to the switching regulator 646. In one embodiment, the switching regulator 646 is a Linear Technology LT1111 Micropower DC/DC Converter. The pin functions for the exemplary linear regulator 644 are as follows:

| Pin | Function |
|---|---|
| 1 | current limit |
| 2 | input supply voltage |
| 3 | collector of internal power transistor |
| 4 | regulator output |
| 5 | ground |
| 6 | comparator output |
| 7 | comparator input |
| 8 | feedback |

Filter 647 prevents transients from getting into switching regulator 646 and also prevents switching and load transients from being reflected into the 4 to 20 mA loop. The voltage from the filter 647 provides the input supply voltage and is also supplied through a resistor 642 to the current limit input. Moreover, capacitors 636, 637, 638, and 639 of filter 647 store energy received from node 218. This energy can be used by the switching regulator 646 if the power provided by the current control circuit 204 is insufficient for the load of the switching regulator 646.

An internal voltage comparator of the switching regulator 646 is used to ensure that the input voltage from the current control circuit 204 is sufficient. The voltage comparator of the switching regulator 646 compares the voltage between resistor 674 and resistor 672 with the internal reference voltage (1.25 volts) of switching regulator 646. A small positive feedback to prevent oscillation is provided to the comparator by a resistor 680. If the voltage at the input of the switching regulator 646 falls below approximately 9.6 volts, the output of the switching regulator 646 comparator goes low. When the output of the comparator goes low, a power fail warn signal *PFW is asserted which acts as an interrupt to the microprocessor of the associated device 308. The resistor 678 acts as pull up resistor for the power fail warn signal *PFW.

The output of the switching regulator is snubbed by a Schottky diode 682 and filtered by an inductor 684 and a capacitor 686 to create a voltage +VS. This voltage +VS is input back into the feedback input of the switching regulator 646 via a divider formed by a resistor 692 and a resistor 694, which are scaled to cause +VS to be +3.3 volts. The voltage +VS is filtered by an inductor 688 and a capacitor 690, resulting in the desired voltage +VCC of 3.3V. The voltage +VCC is then used to power the microprocessor and other electronic circuits of the associated device 308.

Figure 8:
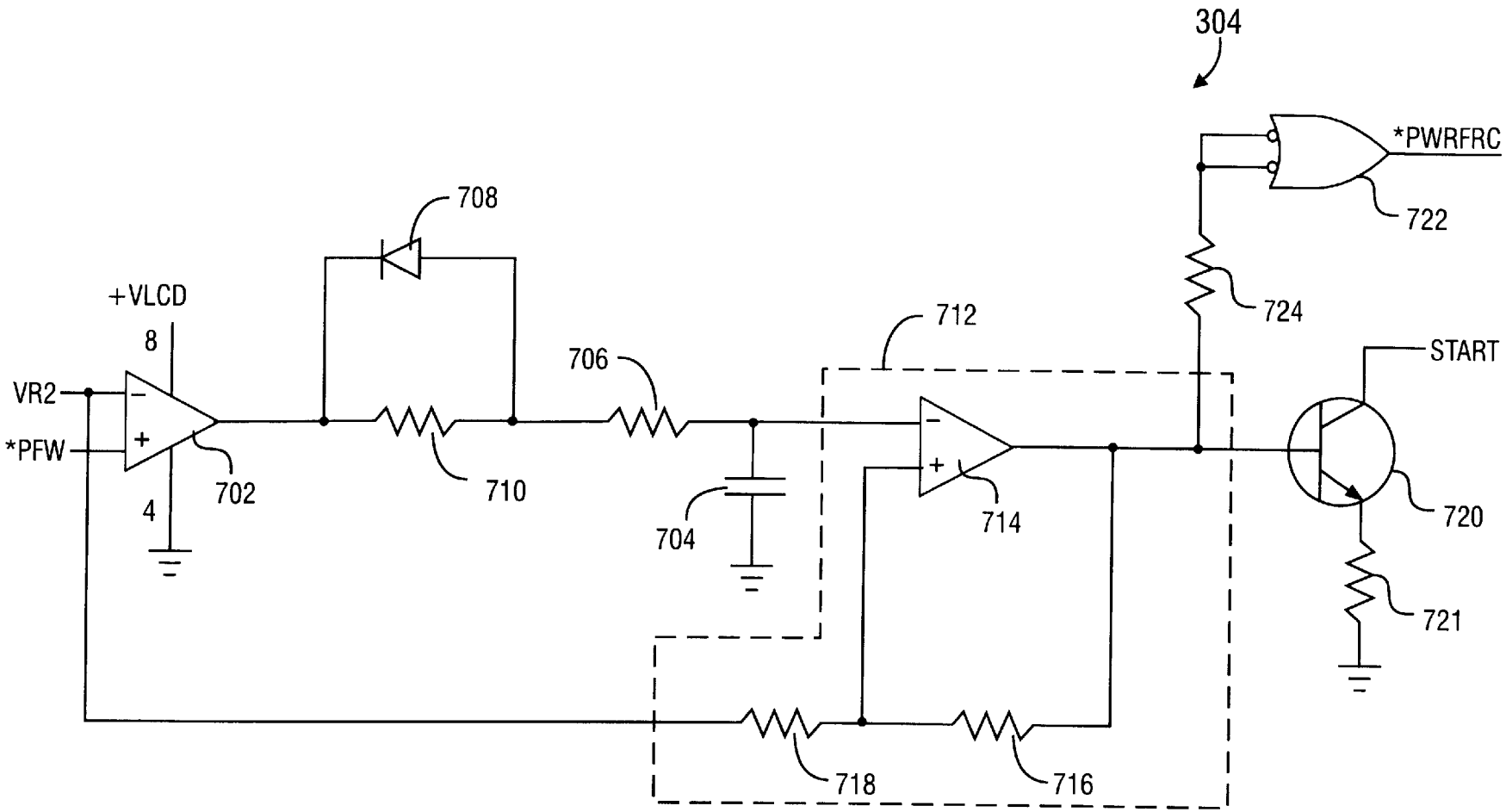
FIG. 8 illustrates a circuit diagram of an embodiment of the power fail detect delay circuit of the present invention.

Referring now to FIG. 8, an embodiment of the power fail detect delay circuit 304 is shown. The power fail warn signal *PFW from the switching regulator 646 is input into a comparator 702. The comparator 702 compares the power fail warn signal *PFW with the reference voltage VR2 of the linear regulator 644. If *PFW is asserted (low), then the output of the comparator 702 goes low. This discharges a capacitor 704 through a resistor 706 and a zener diode 708. Resistor 710 is short circuited by diode 708. In an embodiment of the invention, one half of an LMC6762 dual comparator provides the comparator 702.

The capacitor 704 is connected to a Schmidt Trigger 712 comprised of a comparator 714, a resistor 716, and a resistor 718. In the embodiment illustrated in FIG. 8, one half of an LMC6762 dual comparator provides the comparator 714 for the Schmidt trigger 712. The output of the comparator 714 is connected to a transistor 720 and through a resistor 724, to a NAND gate 722. An emitter resistor 721 is coupled between the transistor 720 and ground. When the capacitor 704 discharges, the output of the comparator 714 goes high. Because the capacitor 704 takes about 5 milliseconds to discharge, the comparator 714 goes high approximately 5 milliseconds after *PFW is asserted. This turns on the transistor 720 and asserts a START signal. At the same time, a power force signal *PWRFRC is asserted (low) through the NAND gate 722.

The START signal is input into the loop current regulating circuit 200 (see FIG. 2 and FIG. 5) and causes loop current regulating circuit 200 to admit the maximum voltage to the switching regulator 646, as explained more fully below. The power force signal *PWRFRC informs the microprocessor 309 of the associated device 308 that power is forced on and therefore the current loop is uncontrolled (but limited to approximately 25 mA).

As the voltage rises at the input of the switching regulator 646, it is sensed by the comparator of the switching regulator 646 and *PFW is turned off (high). The comparator 702 of the power fail detect delay circuit 304 senses this and begins to charge the capacitor 704 through the resistors 710 and 706. The zener diode 708 is now biased off. The capacitor 704 takes about 50 ms to charge beyond the trigger level of the Schmidt trigger 712. Once the charge rises above this trigger level, START and *PWRFRC are negated. Control of the loop current is then passed back to the microprocessor 308 of the flow associated device 308.

If the load of the switching regulator 646 draws more current than the current demand signal VIDMD permits, the upper active device 206 conducts less and begins to starve the switching regulator 646 of voltage. The switching regulator 646 is then forced to run on the Micropower DC/DC Converter. The pin functions for the exemplary linear regulator 644 are as charge stored in the three capacitors 638, 639, and 640 of filter 647 (illustrated in FIG. 7). A continued over current condition may cause the input voltage to the switching regulator to fall to the level required to trip the power fail warn signal *PFW. As explained above, the power fail warn signal *PFW acts as an interrupt to warn the microprocessor 309 of the associated device 308 of the overcurrent condition. When the power fail warn signal *PFW is asserted for approximately 5 ms, the power fail detect delay circuit 304 will assert the signals START and *PWRFRC, as described above. Asserting START will force the upper active device 206 (best illustrated in FIG. 5) to admit the maximum voltage to the input of the switching regulator 646 until approximately 50 ms after *PFW is negated. The lower active device 208 is isolated from the START signal by the diode pair 654.

Referring back to FIG. 5, when the load of the switching regulator 646 does not draw enough current to utilize all of the demanded loop current, the voltage at the collector of reach up active device 630 will decrease, gradually turning on the lower active device 208. The lower active device 208 then begins to sink the excess current until the current demand is satisfied. For example, if the demanded loop current is 20 mA and the switching regulator is only drawing 17 mA, the excess 3 mA will be dissipated to ground by the lower active device 208. A drain resistor 660 of the lower active device 208 aids in the dissipation of power. A source resistor 448 adds some negative feedback to the lower active device 208 and helps to provide a smooth crossover between the conduction of the upper active device 206 and the lower active device 208.

Controlling an active device such as the lower active device 208 with the reach up active device 630 allows the dissipation of excess power only when necessary. When not required to sink current, the lower active device 208 conducts only a small amount. Thus, power is not wasted as with the prior art linear shunt regulator shown in FIG. 1, where the zener diode 116 caused the dissipation of power when the breakdown voltage of approximately 7 V was reached at node 118. Moreover, the voltage at node 218 of the loop current regulating circuit 200 is allowed to float to the voltage necessary to provide the demanded current and permit maximum voltage to the switching regulator 646. In the prior art current control circuit 100 of FIG. 1, the voltage at node 118 is held at the artificial breakdown voltage of approximately 7 volts by the zener diode 116. Further, the impedance provided by the current control circuit 204 appears to the transmitting source as a standard RC impedance, unlike the complex impedance caused by the prior art current control circuit 112 of FIG. 1. This standard RC impedance will not distort the FSK signals as the complex impedance of the prior art can.

Figure 9:
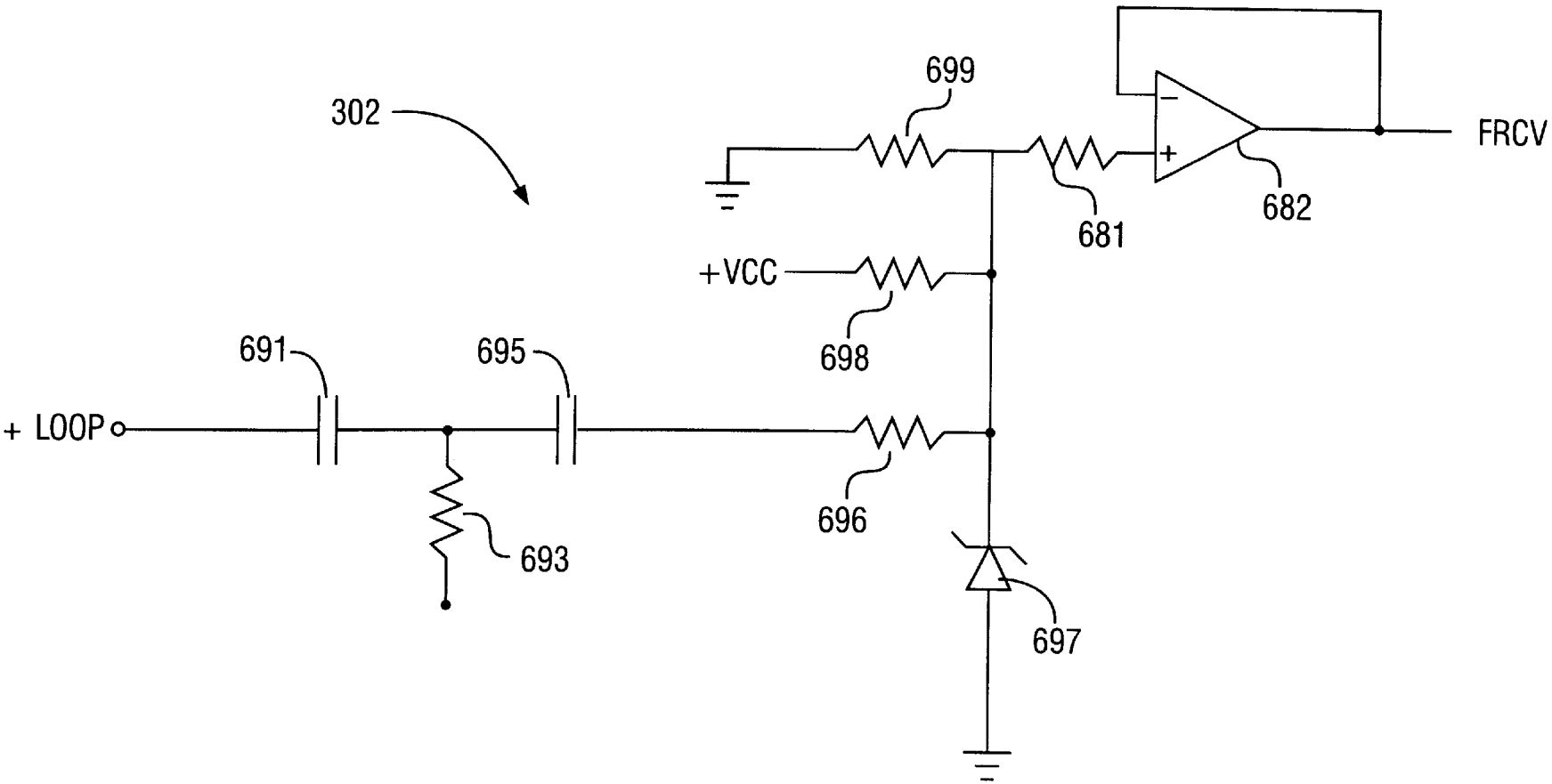
FIG. 9 illustrates a circuit diagram of an embodiment of the FSK receive circuit of the present invention.

Referring now to FIG. 9, the FSK receive circuit 302 receives the FSK signal from the +LOOP voltage. The FSK signal is filtered off the current loop at +LOOP voltage by a capacitor 691, a resistor 693, and a capacitor 695. A resistor 696 and a zener diode 697 limit the transients. The FSK signal is biased by a divider formed by a resistor 698 and a resistor 699 and input through a resistor 681 to an operational amplifier 682, which buffers the FSK signal. The output of the operational amplifier 682 is the signal FRCV which is connected to a modem circuit on the microprocessor board of the associated device 308.

Figure 10:
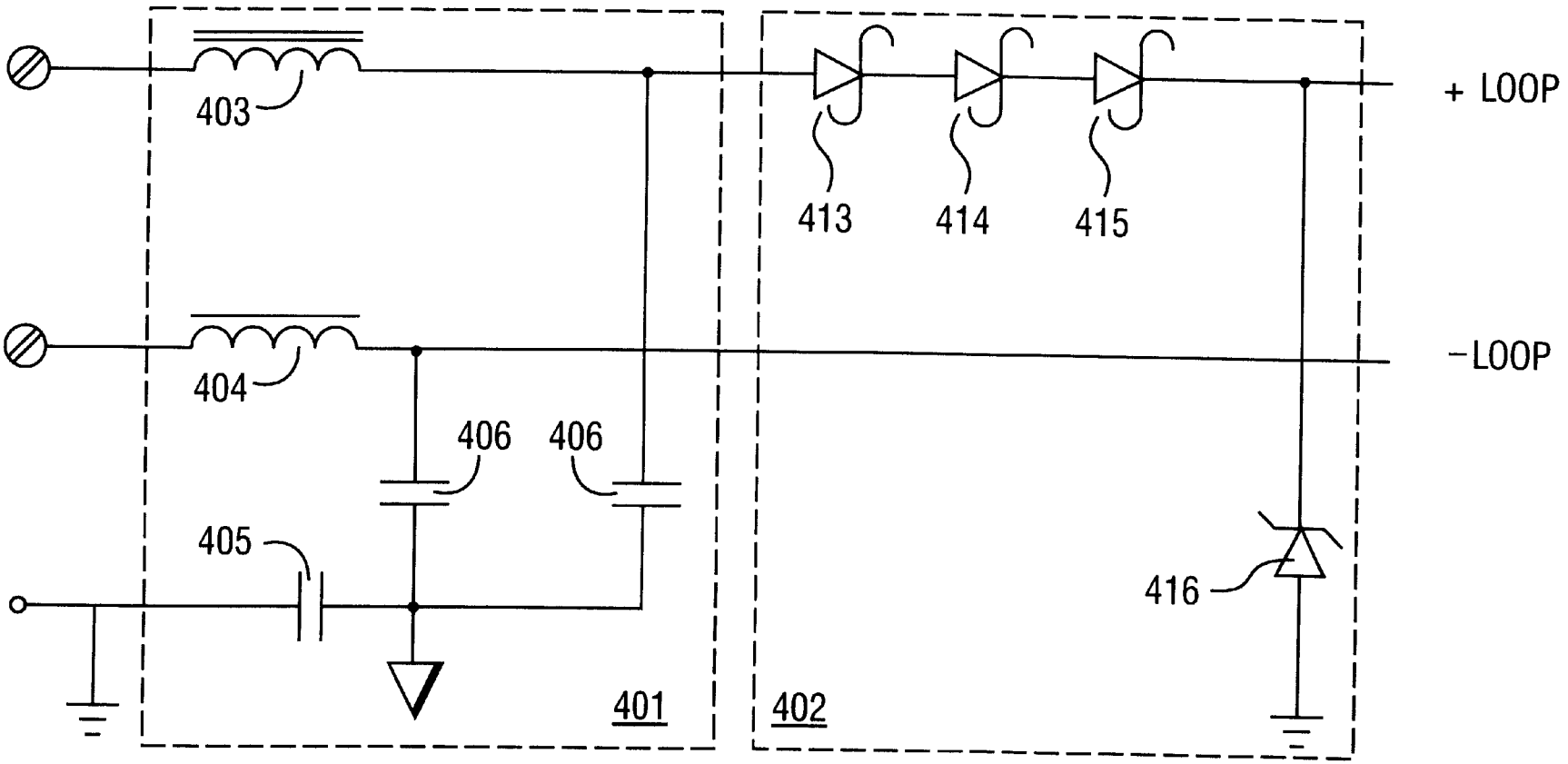
FIG. 10 illustrates a circuit diagram of an embodiment of the loop EMC filter and intrinsically safe protection circuit of the invention.

Turning now to FIG. 10, embodiments of a loop EMC filter 401 and an intrinsically safe protection circuit 402 are shown. The EMC filter 401 is composed of first and second ferrite beads 403 and 404, and three capacitors 405, 406 and 407. The EMC filter 401 serves to attenuate noise and transients into or out of the power manager circuit 300.

The intrinsically safe protection circuit 402 is comprised of three series blocking diodes 413, 414, and 415 and a TVS diode 416. These diodes provide an energy limiting barrier through which the power management circuit 300 receives its operating voltage +LOOP and −LOOP. This energy limiting barrier reduces electrical discharges capable of causing combustion of the surrounding materials. The diodes 413, 414, 415 and 416 prevent damage by reverse connection of loop voltage and prevent discharge of any capacitance if the loop voltage is shorted. This, in turn, prevents any sparks from occurring in a hazardous area.

The above description of several exemplary embodiments is made by way of example and not for purposes of limitation. Many variations may be made to the embodiments and methods disclosed herein without departing from the scope and spirit of the present invention. The present invention is intended to be limited only by the scope and spirit of the following claims.

We claim as our invention:

1. A loop current regulating circuit for producing a demanded current in a loop current circuit that contains an actual current, comprising:

a current compare circuit receiving a demanded current signal, said current compare circuit comparing the actual current to the demanded current signal and producing a control signal;

an active upper device receiving said control signal and conducting based on said control signal to produce said demanded current;

an active lower device receiving said control signal and conducting based on said control signal to produce said demanded current, said active lower device biased to conduct only when needed to drain excess demanded current; and an intermediate node where said active upper device and said lower device are electrically coupled, and said voltage at said intermediate node able to float to the voltage necessary to provide said demanded current.

2. The loop current regulating circuit of claim 1, further comprising:

a receive FSK circuit coupled to said current loop, said receive FSK circuit receiving frequency shift key signals from said loop current circuit; and a transmit FSK circuit coupled to said loop current circuit, said transmit FSK circuit transmitting frequency shift key signals on said current loop.

3. The loop current regulating circuit of claim 1, further comprising:

an EMC filter; and series blocking diodes.

4. The loop current regulating circuit of claim 1, wherein said upper active device is a MOSFET.

5. The loop current regulating circuit of claim 1, wherein said lower device is a MOSFET.

6. The loop current regulating circuit of claim 1, further comprising a reach up active device, said reach up active device receiving control signal from said comparison circuitry and controlling said active upper device and said lower device.

7. The loop current regulator of claim 6, wherein said reach up active device is an NPN transistor.

8. A power management circuit for producing a demanded current in a loop current circuit that contains an actual current and providing power to an associated device, comprising:

a current compare circuit receiving a demanded current signal, comparing said actual current to said demanded current signal and producing a control signal;

an active upper device receiving said control signal and conducting based on said control signal to produce said demanded current;

an active lower device receiving said control signal and conducting based on said control signal to produce said demanded current, said active lower device biased to conduct only when needed to drain excess demanded current;

an intermediate node where said active upper device and said lower device are electrically coupled having a voltage, and said voltage at said intermediate node able to float to the voltage necessary to provide said demanded current; and a power regulating circuit receiving said voltage from said intermediate node and outputting at least one lesser voltage to said associated device.

9. The power management circuit of claim 8 wherein said power regulating circuit comprises:

a transient filter receiving voltage from said intermediate node and storing energy received from said intermediate node;

a switching regulator receiving voltage from said transient filter and outputting a lesser voltage; and a linear regulator receiving a voltage from said loop current circuit and outputting a lesser voltage.

10. The power management circuit of claim 8, further comprising:

a power fail detect delay circuit providing a first signal to said active upper device to increase said voltage at said intermediate node and a second signal to said associated device when said voltage at said intermediate node is not enough for said power regulating circuit.

11. The power management circuit of claim 9 wherein the linear regulator shuts down the switching regulator when the voltage received by the linear regulator falls below a predetermined level.

12. A power management circuit for producing a demanded current in a loop current circuit that contains an actual current and providing power to an associated device, comprising:

a current compare circuit receiving a demanded current signal, comparing said actual current to said demanded current signal and producing a control signal;

an active upper device receiving said control signal and conducting based on said control signal to produce said demanded current;

an active lower device receiving said control signal and conducting based on said control signal to produce said demanded current, said lower device biased to conduct only when needed to drain excess demanded current;

an intermediate node where said active upper device and said lower device are electrically coupled, and said voltage at said intermediate node able to float to the voltage necessary to provide said demanded current;

a reach up active device, said reach up active device receiving control signal from said comparison circuitry and controlling said active upper device and said lower device;

a receive FSK circuit coupled to said current loop, said receive FSK circuit receiving frequency shift key signals from said current loop;

a transmit FSK circuit coupled to said current loop, said transmit FSK circuit transmitting frequency shift key signals on said current loop; and a power regulating circuit receiving said voltage from said intermediate node and outputting at least one lesser voltage to said associated device.

13. A method of creating a demanded current in a loop current circuit containing an actual current, comprising the steps of:

sensing said actual current on said loop current circuit;

comparing said actual current to a signal representation of said demanded current;

creating a control signal from said comparison of said actual current and said signal representation of said demanded current; and creating a demanded current by controlling an upper active device and a lower device with said control signal such that a voltage at an intermediate node between said upper active device and lower device can vary as necessary to attain said demanded current.

14. The method of creating a demanded current of claim 13, further comprising the steps of:

stepping down said voltage at said intermediate node; and providing said stepped down voltage to an associated device.

15. A method of creating a demanded current in a loop current circuit containing an actual current, comprising the steps of:

sensing said actual current on said loop current circuit;

comparing said actual current to a signal representation of said demanded current;

creating a control signal from said comparison of said actual current and said signal representation of said demanded current;

creating a demanded current by controlling an upper active device and a lower device with said control signal such that voltage at an intermediate node between said upper active device and lower device can vary as necessary to attain said demanded current;

stepping down said voltage at said intermediate node; and providing said stepped down voltage to an associated device.

16. A current regulating circuit for creating a demanded current for use in a loop current circuit with an actual voltage, comprising:

means for sensing said actual current on said loop current circuit;

means for comparing said actual current to a signal representation of said demanded current;

means for creating a control signal from comparison of actual current and said signal representation of said demanded current; and means for creating a demanded current by controlling an upper active device and a lower device with said control signal such that voltage at an intermediate node between said upper active device and lower device can vary as necessary to attain said demanded current.

17. The loop current regulating circuit of claim 16, further comprising:

means for stepping down said voltage at said intermediate node; and means for providing said stepped down voltage to an associated device.

18. The loop current regulating circuit of claim 16, further comprising means for receiving FSK signals and means for transmitting FSK signals.

19. A power management circuit for use in a loop current circuit with an actual current and a demanded current, comprising:

means for sensing said actual current on said loop current circuit;

means for comparing said actual current to a signal representation of said demanded current;

means for creating a control signal from comparison of actual current and said signal representation of said demanded current;

means for creating a demanded current by controlling an upper active device and a lower device with said control signal such that voltage at an intermediate node between said upper active device and lower device can vary as necessary to attain said demanded current;

means for stepping down said voltage at said intermediate node; and means for providing said stepped down voltage to an associated device.

* * * * *